United States Patent [19]

Dibold et al.

[11] Patent Number: 4,595,381

[45] Date of Patent: Jun. 17, 1986

[54] TOY VEHICLE WITH ELECTRIC MOTOR

[75] Inventors: Camille Dibold, Bischoffsheim; Frederic Rubach, Ostwald, both of France

[73] Assignee: Joustra S.A., Illkirch Graffenstaden, France

[21] Appl. No.: 541,345

[22] PCT Filed: Jan. 18, 1983

[86] PCT No.: PCT/FR83/00011

§ 371 Date: Sep. 6, 1983

§ 102(e) Date: Sep. 6, 1983

[87] PCT Pub. No.: WO83/02400

PCT Pub. Date: Jul. 21, 1983

[30] Foreign Application Priority Data

Jan. 19, 1982 [FR] France ..... 82 00863
Jan. 10, 1983 [FR] France ..... 83 00369

[51] Int. Cl.[4] ..... A63H 29/24
[52] U.S. Cl. ..... 446/463
[58] Field of Search ..... 446/462, 463, 457, 466, 446/469, 429, 443, 484, 431, 436, 441, 460, 461, 464

[56] References Cited

U.S. PATENT DOCUMENTS

| | | | |
|---|---|---|---|
| 3,634,969 | 1/1972 | Harlting et al. | 446/463 |
| 3,735,525 | 5/1973 | Freed | 446/435 |
| 4,059,918 | 11/1977 | Matsushiro | 446/443 |
| 4,422,263 | 12/1983 | Masubuchi | 446/452 |

*Primary Examiner*—Mickey Yu
*Attorney, Agent, or Firm*—Hayes, Davis & Soloway

[57] ABSTRACT

The present invention concerns a toy vehicle with an electric motor.

The vehicle has a drive module (110) situated within a case (111). In the interior of the case are disposed an elecric motor (116) provided with a pinion (118), an inertial mass (114) provided with a pinion (115) and a coupling wheel (125, 126) mounted on a pivoting piece (128). When the pivoting piece is in a second position, the motor (116) launches the inertial mass (114). When the pivoting piece is in a first position, the energy stored by the inertial mass is transmitted to the wheel (124) dependent upon the axle of the movable wheels.

9 Claims, 7 Drawing Figures

TOY VEHICLE WITH ELECTRIC MOTOR

The present invention concerns a toy vehicle comprising an electric motor, movable wheels and a means for driving said movable wheels.

In the field of toy cars, essentially three principal categories of vehicles are known: vehicles without drive mechanism, vehicles driven by an electric motor and vehicles driven by inertia. Said vehicles result from different concepts, often corresponding to differing price ranges and sometimes intended for children of differing ages.

The present invention provides a toy vehicle which integrates two of the above described concepts by combining, in the same vehicle, electric drive and inertial drive.

To this end, the toy vehicle, comprising an electric motor, movable wheels and a mechanism for driving the movable wheels according to the invention, is characterized by the fact that it comprises both an inertial mass coupled with an electric motor, and that the drive mechanism for the movable wheels comprises means for disconnecting the movable wheels from their drive mechanism.

According to the first embodiment, the movable wheels are mounted on the extremities of a rigid axle, and the means for disconnecting said movable wheels from their drive mechanism consists of guide means which allow the rigid axle to occupy a first position in which the movable wheels are coupled with the drive mechanism, and a second position in which the movable wheels are disconnected from their drive mechanism.

By these means, it is possible to launch the inertial mass by means of the electric motor, the movable wheels being disconnected from their drive means, and then to launch the vehicle by means of the kinetic energy accumulated by the inertial mass by connecting the movable wheels to their drive mechanism.

The guide means comprise at least one oblong slot, the width of which corresponds generally to the diameter of the rigid axle, and the extremities of the slot comprise stop lugs which define the said first and second positions of said axle.

According to one embodiment, said vehicle comprises spring means which urge the rigid axle into its first position, i.e., that in which the movable wheels are connected to their drive mechanism.

It further comprises electrical contact means arranged to close the supply circuit to the electric motor when the rigid axle is in its second position.

In this manner, when the operator acts on the vehicle so as to place the rigid axle in its second position, the supply circuit to the electric motor closes, launches the inertial mass which accumulates a certain kinetic energy, until the vehicle is released and the springs urge the rigid axle to its first position, thereby connecting the movable wheels with the drive mechanism, which has accumulated sufficient kinetic energy to propel the vehicle.

The electric motor, the drive mechanism and the movable wheels carried by the rigid axle preferably are mounted in a supporting case which is integral with the body of the vehicle, and comprises a pair of parallel plates provided with two oblong slots traversed by the said rigid axle. The spring means, which urge the axle into its first position, comprises a movable piece joined to the case and urged by a spring, in such a way that the movable piece pushes the axle into its first position.

Furthermore, the vehicle according to the invention advantageously comprises blocking means disposed to maintain the said rigid axle in its first position. In this manner, the child may use the vehicle as if it were a conventional inertia driven vehicle, specifically, when the batteries for the electric launching motor are not in place.

In this first embodiment, the inertial mass is mounted on the motor shaft. During the launching phase, the motor drives the inertial mass. During the phase of restoration of the energy stored by the inertial mass, the mass, joined to the axle of the movable wheels, drives the wheels as well as the electric motor to which the electric supply has been interrupted. A portion of the stored kinetic energy is thereby wasted in turning the unused motor.

The latter embodiment constitutes a disadvantage which may be overcome by a second embodiment, according to which the toy vehicle is characterized by the fact that the said means for disconnecting the movable wheels comprises a pivoting piece having at least one coupling wheel disposed to join a wheel connected to the output shaft of the electric motor and a wheel connected to the axle of the inertial mass when the pivoting piece is in its first position, and to join a wheel connected to the axle of the movable wheel, and the wheel connected to the axle of the inertial mass when the pivoting piece is in its second position.

The coupling wheel comprises two connected wheels of different diameters, one of which provides coupling of the wheel connected to the motor shaft to the wheel connected to the inertial mass, and the other of which provides coupling of the wheel dependent upon the axle of the movable wheels to the wheel dependent upon the inertial mass, said two wheels being alternatively engaged and disengaged when the pivoting piece is in its first or second position.

Here, the inertial mass is no longer dependent upon the shaft of the electric motor and the coupling wheel may, according to the position of the pivoting piece, engage or disengage the motor and engage or disengage the movable wheels. In this way, the electric motor is never operated without putting its energy to use and the energy stored by the inertial mass is integrally restored to the movable wheels without waste.

According to a particular embodiment, the coupling wheel, at least, is a friction wheel covered with a material having a high coefficient of friction.

To ensure a supply of energy to the electric motor, the pivoting piece comprises a tip disposed to touch a thin contact plate when the latter is in its first position, the contact plate being connected to one of the poles of the electric motor's energy source in such a way that completing the contact between the said tip and the said contact plate provides the energy supply to the electric motor.

Manipulating the pivoting piece is accomplished by means of a drive lever connected to the piece, the lever being further equipped with a return spring, in such a way that the pivoting piece is urged into its second position, corresponding to connection of the inertial mass with the movable wheels.

The vehicle is conceived as a modular vehicle. The drive module comprises a case, inside of which are mounted: the electric motor, the inertial mass and the drive mechanism for the movable wheels which holds the axle of the movable wheels, the module being arranged to be mounted on a chassis bearing the energy source for the electric motor and the vehicle body.

The present invention will be better understood with reference to the description of one example of an embodiment thereof and to the attached drawing, in which.

Figure 1:
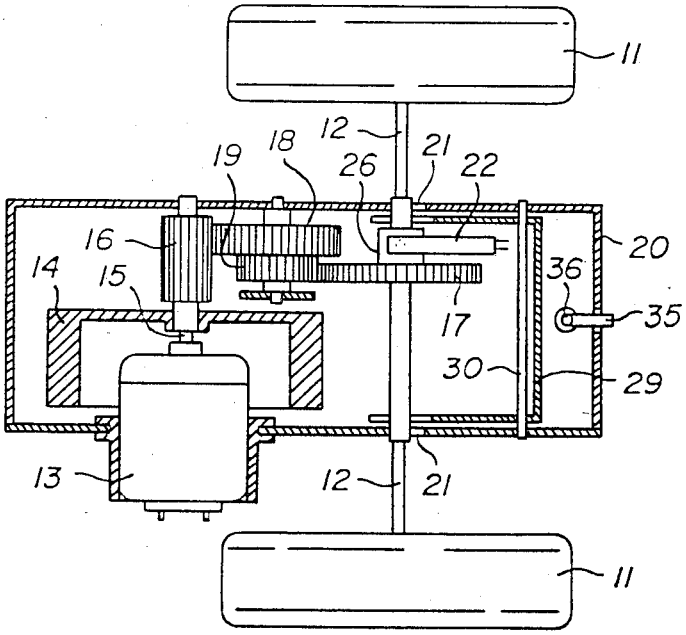
FIG. 1 is a top plan view of a portion of the vehicle according to the invention, illustrating primarily the electric motor, the movable wheels and the drive means.
Figure 2:
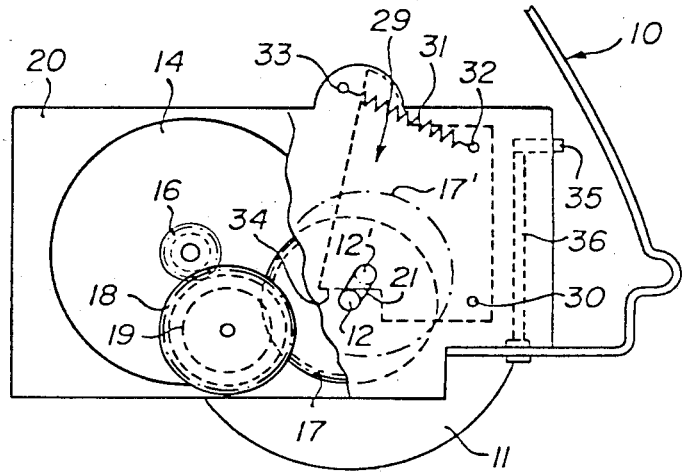
FIG. 2 is a side elevational view of the drive means of FIG. 1.
Figure 3:
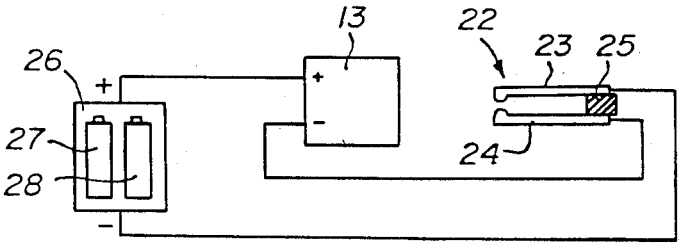
FIG. 3 is a schematic representation of the electric circuit according to the invention.

With reference to FIGS. 1 through 3, the vehicle described consists of a body 10, the rear part of which is represented very schematically in FIG. 2, two movable wheels 11 mounted on the extremities of a rigid shaft 12, and an electric motor 13 which drives the movable wheels 11 by means of a drive mechanism which will be described in greater detail hereinafter.

An inertial bell-shaped mass 14, axially symmetrical, is mounted on motor shaft 15 which also has a drive pinion 16. Said drive pinion 16 is indirectly joined to the gear wheel 17, by means of a reducing gear mechanism comprised, for example, of two gear wheels 18 and 19. Gear wheel 17 is dependent upon drive axle 12 of movable wheels 11. All these elements are mounted on the lateral wall of case 20, which is itself connected, by means known in the art, to the chassis or body of the vehicle.

The lateral walls of case 20 each have an oblong slot 21, the axis of which preferably forms an angle of from 30° to 45° in relation to the vertical. Slots 21 are traversed by axle 12 which may, hence, adopt a first position represented by the solid lines in FIG. 2, and a second position 12' represented by broken lines. When axle 12 is in its first position gear wheel 17 meshes with gear wheel 19 dependent upon wheel 18, which is itself held by pinion 16 mounted on the drive shaft 15 of electric motor 13. In this position, the movable wheels are connected to the electric motor by means of their drive mechanism.

On the other hand, as is shown in FIG. 2, when axle 12 is in the elevated position indicated by reference 12', gear wheel 17, dependent upon said axle, is upwardly diverted and occupies a position designated by reference 17', in which it no longer is meshed with gear wheel 19. In this case, movable wheels 11 are disconnected from their drive mechanism.

The apparatus above described and illustrated primarily in FIG. 1 comprises a means of electrical contact 22 consisting essentially of two contact plates 23 and 24 separated by an isolating plug 25 (see FIG. 3), the lower plate of which is angularly positioned against a cylindrical isolating weight 26 coaxially mounted on drive axle 12. When drive axle 12 is in its lowered position, contact plates 23 and 24 are separated, and the circuit joining current source 26 comprising, for example, two electric batteries 27 and 28 to the motor, is open.

On the other hand, when the drive axle is in position 12', plug 26 causes lower contact plate 24 to become angularly positioned against upper contact plate 23, and closes the supply circuit to electric motor 13. The latter begins to move, while driving inertial mass 14, and further driving pinion 16 and gears 18 and 19. As movable wheels 11 are not connected to the drive mechanism in this position, the former remain stationary and the vehicle does not move.

The upper position 12' of the drive axle is achieved when the child leans on the vehicle body while the vehicle is on a rigid surface. The lower position, which is the resting position, is maintained in the absence of other constraints by virtue of a movable piece 29, joined to a pivot 30 and urged into position by spring 31 affixed on one side to a pin 32 connected to piece 29, and on the other side to pin 33 connected to case 20. Piece 29 is preferably a folded U-shaped piece, the two lateral branches of which each comprise a segment 34 in contact with drive axle 12.

A cam 35, mounted on pivoting axle 36, allows piece 29 to be stopped in the resting position, i.e., to maintain drive shaft 12 in its lowered position.

To play with the vehicle according to the invention, the child presses against vehicle body 10 adjacent its rear movable wheels 11. This has the effect of displacing drive axle 12 from its lowered position towards its raised position 12', thereby joining contact plates 23 and 24 and closing the supply circuit to electric motor 13 which begins to drive inertial mass 14. This mass accumulates a certain kinetic energy, which may be transmitted to the drive mechanism at the moment the child releases pressure on body 10, the effect of which is to place the drive axle in its initial position under the influence of traction spring 31. As a result, after a first launching phase, in the course of which a certain quantity of kinetic energy is accumulated by inertial mass 14, the second phase consists of restoring said kinetic energy and transmitting it suddenly to the movable wheels by means of an automatic coupling of said movable wheels with their drive mechanism, thus providing spectacular vehicle acceleration.

When the batteries are worn out, the vehicle may be used in the classic manner as an inertia-launched vehicle. To do this, it is necessary only to turn cam 35 around its axle 36 to block piece 29 in the position shown in FIG. 2, corresponding to the first so-called lowered position of drive axle 12. Inertial mass 14 then begins to rotate by virtue of the fact that movable wheels 11 are connected to the drive mechanism, and no longer by means of electric motor 13.

The description of a particular embodiment of the invention shows that this invention integrates two known means of propulsion into one entity. Furthermore, the previous launching of the inertial mass provides spectacular vehicle acceleration by means of a relatively simple mechanism and consequently at relatively low production cost.

This mechanism may be just as easily adapted to a toy camper as to a truck, an airplane equipped with wheels, a motorcycle, a model racer, etc. It is necessary only that the vehicle have a chassis with wheels.

Figure 4:
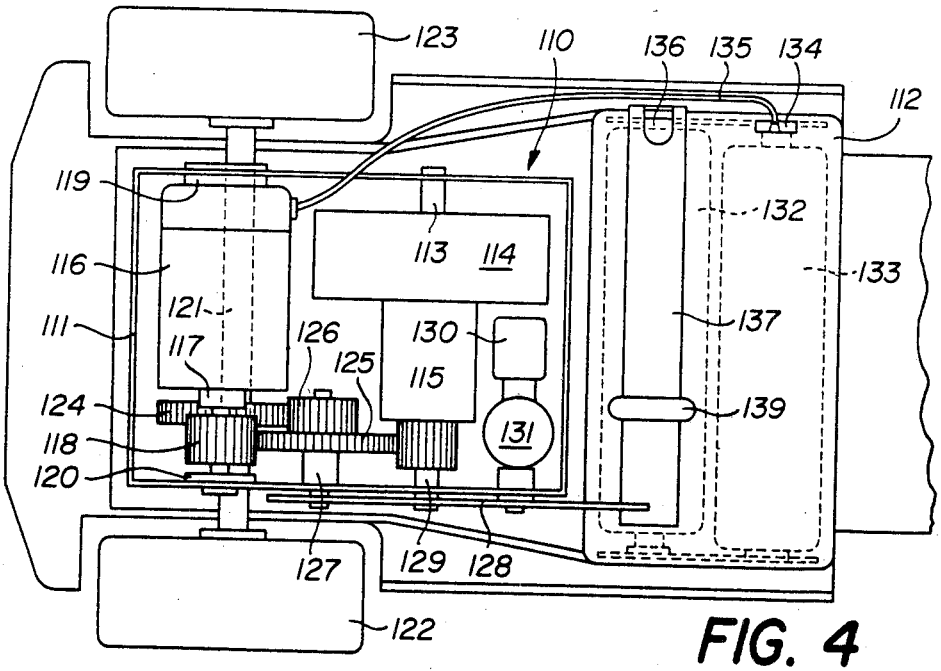
FIG. 4 is a plan view illustrating the drive module of the vehicle according to the invention, mounted on the chassis of the vehicle.

With reference to FIGS. 4 through 7 and particularly to FIG. 4, drive module 110 comprises a case 111 comprised of the four sides of a parallelepiped rectangle, and mounted in an appropriately disposed recess in vehicle chassis 112. The case connects axle 113 of the inertial mass 114 as well as a gear wheel 115, preferably made of one piece and cast, to inertial mass 114. It also holds electric motor 116 whose output shaft 117 holds gear wheel 118 rigidly mounted on said shaft. Motor body 116 is provided with a protruberance 119 engaged in an appropriate opening of one of the sides of case 11, thereby permitting it to support and maintain in position one side of the unit formed by motor 116 and gear wheel 118. The other side of this unit is held by bearing 120 situated in an appropriate opening of another lateral wall of case 111. Axle 121 of movable wheels 122 and 123 traverses case 111 from one side to the other and is supported by two lateral walls opposite the case. Said axle holds gear wheel 124 which is rigidly affixed to said axle.

The means for disengaging movable wheels 122 and 123 from the vehicle consist of the coupling wheel comprised, in the example illustrated, of two interconnected gear wheels 125 and 126, the axle 127 of which is mounted on one of the extremities of pivoting piece 128, perpendicular to its plane. Axle 127 traverses an oblong slot disposed in the corresponding lateral wall of case 111. Pivoting piece 128 changes position on extremity 129 of axle 113 of inertial mass 114.

Figure 5:
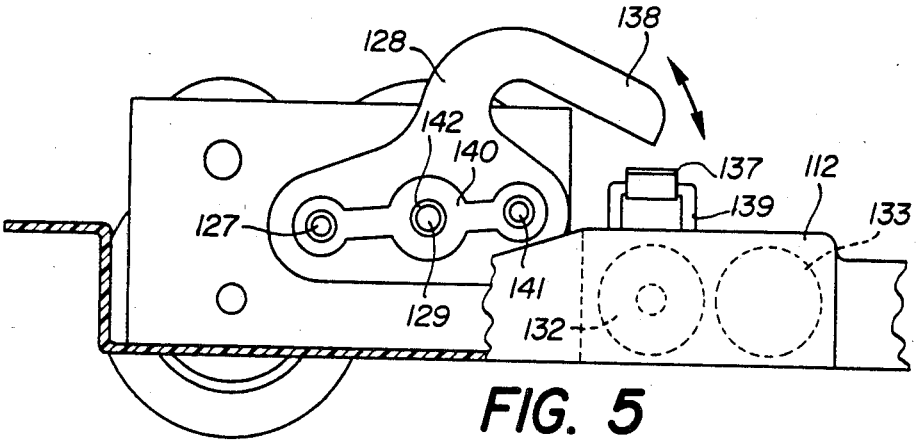
FIG. 5 is a side elevational view of said module, illustrating primarily the pivoting piece.
Figure 6:
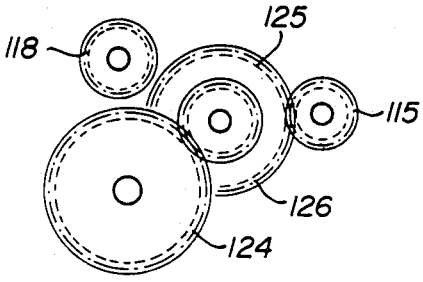
FIG. 6 is a schematic view illustrating the kinematic chain when the pivoting piece is in its second position.
Figure 7:
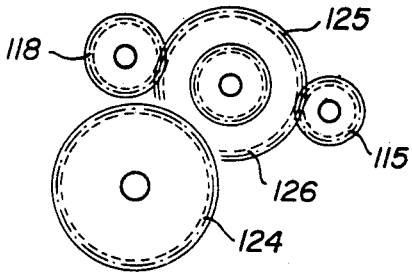
FIG. 7 is a schematic view illustrating the kinematic chain when the pivoting piece is in its first position.

Command lever 130, movable along an axis perpendicular to the plane of the drawing, is connected to tubular piece 131 which contains a compression spring (not shown) tending to push lever 130 upwardly (in the position illustrated in FIG. 5).

Chassis 112 contains the source of energy to motor 116, comprising, for example, two dry cell batteries 132 and 133 connected in series. The positive terminal 134 of said source is connected to one of the poles of motor 116 by means of wire 135. Negative terminal 136 of the source is connected to a conductive plate 137 in chassis 112.

Pivoting piece 128 comprises a tip 138 designed to contact plate 137, the corresponding extremity of which is slightly upwardly curved and is held in place by retaining means 139 connected to the chassis and disposed above batteries 132 and 133.

As is shown in FIG. 5, pivoting piece 128 has a raised area 140 made, for example, by stamping, on which are mounted axle 127 of the coupling wheel and projection 141 connected to tubular piece 131, joined to command lever 130. As previously mentioned, pivoting piece 128 alternates position around extremity 129 of axle 113 of inertial mass 114. To achieve this, it (pivoting piece 128) has a level portion 142 serving as a support for the said extremity of the axle.

At rest, command lever 130 is pushed upwardly by means of the compression spring situated in tubular piece 131. Pivoting piece 128 is in its raised position shown in FIG. 5. Tip 138 is not angularly positioned against contact plate 137. The gear wheels are in the position illustrated in FIG. 6. Wheel 124 meshes with wheel 126 and wheel 125 enmeshes toothed pinion 115 dependent upon inertial mass 114. The electric motor is not supplied with current and gear wheel 118 is not coupled with the other gear wheels.

When the user wishes to launch the vehicle, he presses on command lever 130. The effect of this is to make pivoting piece 128 change position so that contact is completed between tip 138 and the contact plate. The motor is then supplied with current by the electrical energy source. Simultaneously, the coupling wheel changes position, thereby disengaging wheels 124 and 126 and meshing wheels 125 and 118. The motor drives pinion 118, wheels 125 and 126 and pinion 115. The inertial mass is launched by the motor and stores some kinetic energy.

When the user releases command lever 130, the pivoting piece returns to its initial position, causing the electricity supply to the motor to be cut off, wheels 118 and 125 to disengage and wheels 126 and 124 to engage. The kinetic chain consists of pinion 115, wheel 125, interdependent wheels 126 and 125 and wheel 124. In other words, the energy stored by the inertial mass is transmitted to the movable wheels.

It is understood that the present invention may be varied in ways evident to one skilled in the art. By way of example, the gear wheels and especially the coupling gear wheel could be replaced by a friction wheel.

We claim:

1. A toy vehicle having wheels with a drive axle and comprising:

(a) an electric motor, an electrical energy source therefor and electrical contact means for energizing and deenergizing the electric motor, (b) a drive mechanism associated with said drive axle and with said electric motor, add (c) guide means associated with said drive axle and said drive mechanism so as to provide relative movement between a first position for drivingly connecting the drive axle to the drive mechanism and a second position for disconnecting the drive axle from the drive mechanism, said toy vehicle comprising the improvements consisting of (d) said electric motor (13) is operatively assocaited with an inertial mass (14) so that when pivoting motor is energized it drives this inertial mass to thereby impart kinetic energy thereto for subsequent delivery of said energy from the inertial mass to said drive axle (12), and (e) said drive axle (12), said drive mechanism (15–19), said guide means (21) and said electrical contact means (22) are operatively associated in such a manner that, in said first position, said electric motor (13) is deenergized while said drive axle (12) is drivingly connected to said inertial mass (14) via said drive mechanism (15–19) and, in said second position, said electric motor (13) is energized while said drive axle (12) is disconnected from the drive mechanism (15–19), whereby the energized electrical motor drives said inertial mass (14) when said drive axle (12) is disconnected from the drive mechanism (15–19), the said improvements being arranged so that in said first position the toy vehicle can be propelled so as to provide acceleration thereof by means of kinetic energy accumulated in said inertial mass each time after its has been driven by said electric motor in said second position.

2. A vehicle according to claim 1, characterized by the fact that it comprises blocking means (35) disposed to maintain the said drive axle in its first position.

3. A toy vehicle according to claim 1, characterized by the fact that the said guide means comprises a pivoting piece having a coupling wheel means disposed to connect with a wheel (118) mounted upon an output shaft of the electric motor (116) and a wheel (115) connected to the inertial mass (114) when the guide means is in said second position, and to connect a wheel (124) mounted upon the drive axle (121) of the vehicle wheels (122 and 123) and the wheel (115) connected to the inertial mass (114) when the guide means is in said first position.

4. A vehicle according to claim 3, characterized by the fact that said coupling wheel means is comprised of two interconnected wheels (125 and 126), of differing diameters, one of which (125) ensures connection of the wheel mounted upon the motor output shaft with the wheel connected to the inertial mass, and the other of which (126) ensures connection of the wheel mounted upon the drive axle of the vehicle wheels to the wheel connected to the inertial mass, said two wheels (125 and 126) being alternatively engaged and disengaged when the guide means is in its first or second position.

5. A vehicle according to claim 3, characterized by the fact that the said coupling wheel means is a friction wheel having a surface with a high coefficient of friction.

6. A vehicle according to claim 4, characterized by the fact that the said wheels (118, 115, 124, 125, 126) are gear wheels.

7. A vehicle according to claim 3, characterized by the fact that the guide means comprises a tip (138) disposed to touch a contact plate (137) when the guide means is in its second position, said contact plate being connected to one of the poles of the source of energy for the electric motor, in such a way that contact between the said tip (138) and the said contact plate (137) ensures the supply of energy to the motor.

8. A vehicle according to claim 3, characterized by the fact that the said guide means further comprises a command lever connected to the guide means, said lever being equipped with a compression spring, so that the guide means is urged towards its first position.

9. A vehicle according to claim 3, characterized by the fact that it comprises a drive module consisting of a case, inside of which are mounted: the electric motor, the inertial mass and the drive mechanism for the vehicle wheels, and which holds the axle of the wheels, said module being disposed for mounting on a chassis supporting the energy supply for the electric motor as well as the vehicle body.

* * * * *

UNITED STATES PATENT AND TRADEMARK OFFICE
CERTIFICATE OF CORRECTION

PATENT NO. : 4,595,381

DATED : June 17, 1986

INVENTOR(S) : Camille DIEBOLD & Frederic RUBACH

It is certified that error appears in the above—identified patent and that said Letters Patent is hereby corrected as shown below:

Claim 1, Column 6, Line 34, delete "pivoting" and insert in place thereof --said--.

Signed and Sealed this

Twenty-third Day of December, 1986

*Attest:*

DONALD J. QUIGG

*Attesting Officer*

*Commissioner of Patents and Trademarks*